US006277181B1

(12) United States Patent
Condra et al.

(10) Patent No.: US 6,277,181 B1
(45) Date of Patent: Aug. 21, 2001

(54) METHOD TO EXTEND THE BATHLIFE OF ALKALINE ACCELERATOR SOLUTIONS

(75) Inventors: Richard Carroll Condra, Highland Village; Paul Christopher Healey, Garland, both of TX (US)

(73) Assignee: Oliver Sales Company, Dallas, TX (US)

( * ) Notice: Subject to any disclaimer, the term of this patent is extended or adjusted under 35 U.S.C. 154(b) by 0 days.

(21) Appl. No.: 09/374,291

(22) Filed: Aug. 16, 1999

(51) Int. Cl.[7] ..... C23C 18/30

(52) U.S. Cl. ..... 106/1.05; 106/1.11

(58) Field of Search ..... 106/1.05, 1.11

(56) References Cited

U.S. PATENT DOCUMENTS

| | | | | |
|---|---|---|---|---|
| 3,798,050 | * | 3/1974 | Franz et al. | 106/1.11 |
| 4,153,746 | * | 5/1979 | Kilthau | 106/1.11 |
| 4,259,113 | * | 3/1981 | Nuzzi et al. | 106/1.11 |
| 4,933,010 | * | 6/1990 | Okabayashi | 106/1.11 |

* cited by examiner

*Primary Examiner*—Helene Klemanski
(74) *Attorney, Agent, or Firm*—Larry B. Dwight

(57) ABSTRACT

This invention is a method to extend the bath life of certain alkaline accelerators used in metal/tin colloid catalyst used in direct plating processes on printed circuit boards. The method is comprised of the following steps: measuring the pH of the alkaline activator bath, and restoring, the pH of the alkaline activator bath to a desired pH range between 12.2 and 12.6.

4 Claims, No Drawings

METHOD TO EXTEND THE BATHLIFE OF ALKALINE ACCELERATOR SOLUTIONS

BACKGROUND OF THE INVENTION

Certain direct plating processes employ an aqueous alkaline solution to improve the conductivity of the film applied to electrically non-conductive surfaces to make them conductive. The direct plating processes to which this invention applies include those disclosed in U.S. Pat. No. 5,071,517 by Okabayoshi using microfine colloidal catalyst as disclosed in U.S. Pat. No. 4,933,010 also by Okabayoshi.

Workpieces previously processed through cleaner/conditioner and catalyst baths are contacted with the aqueous alkaline solution. The aqueous alkaline solution causes the conductive film applied from the catalyst bath to the non-conductive surfaces of the work pieces to exhibit lower resistance and higher conductivity. Because the aqueous alkaline solution improves or accelerates the performance of the catalyst, it is called an accelerator bath or accelerator solution.

In the normal course of treating workpieces, the efficiency of the accelerator bath deteriorates. The reduced efficiency is displayed by poorer ability to reduce resistance and simultaneously increase conductivity of the conductive film applied by the catalyst. This results in electroplated metal deposits that may incompletely cover the surface or be less uniform than desirable.

This invention improves the performance of deteriorated alkaline accelerator baths and prolongs their useful life.

SUMMARY OF THE INVENTION

This invention is a method to extend the bath life of certain alkaline accelerators used in direct plating processes. The method is comprised of the following steps: 1. measuring the pH of the alkaline activator bath, and 2. restoring the pH of the alkaline activator bath to a desired pH range. A means of calculating the additions required to adjust the pH of the alkaline accelerator bath to the desired range is disclosed.

A primary object of this invention is to prolong the life of alkaline accelerator baths.

A further object of this invention is to improve the performance of used accelerator baths.

A still further object of the invention is to avoid insolubilization of cupric ions, if any present in the accelerator bath.

Other objects of the invention will be apparent to those skilled in the art.

DETAILED DESCRIPTION OF THE INVENTION

The method of this invention is intended to prolong the useful life of alkaline accelerators used with precious metal/tin colloid catalyst direct plating process as disclosed by Okabayoshi. The steps comprising the method include: 1. measuring the pH of the alkaline accelerator bath, using a pH meter or other appropriate means; and 2. restoring the pH of the alkaline accelerator bath to the desired range, usually approximately 12.2 to 12.6, by additions of a hydroxide of alkali metals, including hydroxides of sodium, potassium, lithium, rubidium, cesium, and mixtures thereof. The preferred the form of alkali hydroxide for pH adjustment is an aqueous solution.

The direct plating process usually includes the steps of cleaning/conditioning, application of conductive precious metal/tin colloid catalyst film, acceleration or enhancement of the conductivity of the catalyst film using an alkaline accelerator, and setting or neutralization of alkaline residues with acid. There are usually water rinses between the process steps. Additionally, immersion of workpieces in a predip solution between the rinse after cleaning/conditioning and the application of the catalyst is typical. This predip solution is composed of all of the components of the catalyst bath except the precious metal colloid. It is intended to displace and/or absorb water on the workpieces thereby minimizing introduction of water into the catalyst bath. After the workpieces have been processed through these steps to make the non-conductive portions conductive, they are electroplated, usually with copper.

The accelerators used in this process disclosed by Okabayashi include alkali metal hydroxides and alkali metal carbonates. In commercial applications of the process, the accelerator solution usually contains alkali metal carbonates, such as sodium carbonate or potassium carbonate or a mixture of sodium and potassium carbonate. Typically, the alkali metal carbonate solution contains about 2 to 3 pounds of carbonate salt per gallon of bath (240 to 360 grams per liter of bath). Usually, cupric ions are added to the carbonate solution to further enhance the conductivity of the catalyst film deposited onto workpieces. Typically, the concentration of cupric ions is about 50 to 200 milligrams per liter bath.

It is surprising that cupric ions remain dissolved in such an alkaline bath. One of the well known methods of removing dissolved cupric ions from solution is to make the solution alkaline, so as to precipitate the cupric ions as cupric hydroxide or cupric oxide. Nevertheless, cupric ions in the range of 50 to 200 milligrams per liter do remain dissolved in the alkali carbonate solution. In some commercial applications, chelating agents are added to the accelerator bath to enhance solubility of cupric ions. Whereas, such chelating agents increase the solubility of the cupric ions in the alkaline accelerator bath, especially when the accelerator bath contains alkali hydroxide, they also interfere with subsequent removal of copper from spent baths when the baths are waste treated prior to release to the environment. Since chelated copper compounds are environmentally undesirable from a waste treatment perspective, alkaline accelerator solutions addressed by this invention are primarily those that are free from chelating agents.

In order to evaluate the quality of the conductive film, several methods have been developed. One common method of evaluating the quality of the conductive film applied by the process is to measure the side to side resistance of copper clad dielectric work pieces with through holes. Holes are drilled or punched through planar workpieces or test panels made of dielectric material clad on both sides with copper foil. The side to side resistance of the workpieces or test panels is measured by placing one probe of an ohm-meter on each of the opposite copper clad surfaces and observing the electrical resistance, expressed in ohms, displayed on the ohm-meter. Untreated test panels typically display an open circuit For example, an untreated 2"×3" test panel of epoxy/fiberglass dielectric 0.059" thick, clad on each planar side with copper foil 0.00136" thick, and drilled with 200 holes ranging from 0.020" to 0.090" in diameter will typically exhibit a side to side resistance greater than 10,000,000 ohms. Test panels treated with cleaner/conditioner and catalyst, but without accelerator, typically have side to side resistance of about 5,000 to 100,000 ohms. Test panels treated with cleaner/conditioner, catalyst, and freshly prepared accelerator bath typically exhibit side to side resistance lower than 100 ohms. In general, the lower the resistance of the conductive film, the more complete and uniform will be the metal deposit that is subsequently electroplated onto the conductive film.

As workpieces are processed through the alkaline accelerator bath, its performance, as measured by side to side resistance of processed workpieces or test panels, deteriorates. The resistance of test panels processed in aging accelerator baths often rises from less than 100 ohms initially to more than 1000 ohms. When the resistance rises, the coverage and uniformity of the electroplated deposit are adversely affected. Often, when the resistance exceeds 1000 ohms, the catalyzed surface will not be covered completely with electroplated metal deposit.

In order to compensate for the reduced efficiency of the aging accelerator solution, it is common industrial practice for part of the bath to be discarded and replaced with fresh solution. Typically, about 10 to 20% of the volume of the bath is discarded and replaced with fresh solution. Such replacement of part of the bath improves its performance. After dumping and replacing part of the bath, the resistance of the conductive catalyst film on workpieces is reduced and the uniformity of the subsequent electroplated deposit is improved. After making a number of such replacements of portions of bath with fresh solution, additional replacements no longer improve the performance of the bath adequately to allowed continued use of the bath. Even though analyses of the alkali carbonate by alkalinity titrimetry and copper ions by atomic absorption spectroscopy or by optical comparison with known standards may indicate that the constituents are within the normal concentration ranges, the performance of the bath is inadequate. At that point, the bath is dumped and recharged.

Although discarding and replacing part of the bath with fresh solution extends the useful life of the bath, it would be desirable to extend the life of the bath even longer. Likewise it would be desirable to avoid making such large additions of fresh solution to the bath. It is costly to replace the discarded solution with fresh solution. It would also be desirable to avoid discarding so much of the bath. The discarded solution contains copper, a controlled metal, which must be removed from the solution before it can be released to the environment. Treating the discarded solution to remove the copper is expensive and time consuming. This invention addresses these desires.

We have discovered that even though analyses of the total quantity of alkali carbonate and cupric ions in a used bath indicate that the correct quantity of constituents are present in the bath, the pH of a used bath is not the same as the pH of a freshly prepared bath with the same quantity of alkali carbonate and cupric ions. Invariably, the pH of the aging bath is lower than the pH of a freshly prepared bath with the same concentration of alkali carbonate and cupric ions. For example, freshly prepared solutions of 180 grams per liter sodium carbonate and 180 grams per liter potassium carbonate in deionized water yield a pH of approximately 12.6. After addition of 50 to 200 milligrams per liter cupric ions, in the form of cupric sulfate dissolved in dilute sulfuric acid, the bath exhibits a pH of approximately 12.2. Such freshly prepared baths provide excellent enhancement of the conductivity of conductive films deposited by precious metal colloid catalyst baths.

When such baths are used to process workpieces, even though the concentrations of the constituents are maintained by additions to the bath, the pH falls to approximately 11.6. Such used baths with pH approximately 11.6 do not perform adequately. The side to side resistance of workpieces treated with such baths are dramatically higher than those treated with freshly prepared baths. Often, subsequent electroplated deposits do not cover the surface completely.

We have discovered that it is possible to restore a poorly performing used accelerator bath to an acceptable performance level using only small quantities of alkali metal hydroxide. Typically, additions of less than 1% by weight are required to restore the pH to the range of approximately 12.2 to 12.6, the pH of a freshly prepared bath.

We have further discovered that adding significantly more alkali metal hydroxide than is required to raise the pH to a range of approximately 12.2 to 12.6 adversely effects the bath. When excess hydroxide is added, cupric ions precipitate from the bath as a fine black powder, presumably cupric oxide. The performance of baths with precipitated cupric ions is not as good as the performance of baths adjusted to pH 12.2 to 12.6, which still have the cupric ions in solution.

For example, a used accelerator bath containing approximately 180 grams per liter sodium carbonate, 180 grams per liter potassium carbonate, and 100 milligrams per liter cupric ion has a pH of 11.8. Sodium hydroxide solution is added to several portions of the bath to increase the pH to various pH's from 12.2 to 13.4. Potassium hydroxide or other alkali hydroxide could have been used to adjust the pH of the accelerator bath. Sodium is the preferred pH adjusting agent because it is readily available and is less costly than other alkali metal hydroxides The pH adjusted solutions were heated to 140° F., were stirred intermittently to simulate production conditions, and were observed for precipitate, turbidity, and other indications of cupric ion insolubilization. The results of these observations are recorded in Chart 1.

CHART 1
EFFECT OF pH ADJUSTMENT ON CUPRIC IONS IN BATH

| INITIAL pH | pH AFTER ADJUSTMENT | ml 50% NaOH ADDED PER LITER BATH | EFFECT ON CUPRIC IONS IN BATH |
|---|---|---|---|
| 11.8 | 11.8 | 0 | no adverse effect |
| 11.8 | 12.2 | 2.0 | no adverse effect |
| 11.8 | 12.6 | 3.0 | no adverse effect |
| 11.8 | 13.0 | 4.5 | light precipitate overnight |
| 11.8 | 13.4 | 10.0 | heavy precipitate within 4 hours |

The performance of accelerator baths with pH adjusted to 12.2 and 13.4 were compared with the performance of the original bath with pH 11.8. Test panels as previously described were similarly processed through baths of HN-500™ Cleaner/Conditioner, HN-503™ Predip, HN-504™ Catalyst, one of the alkaline accelerator solutions under test, 10% by volume sulfuric acid, and appropriate rinses. These products are available commercially from Oliver Sales Co., Dallas, Tex. The results of these tests are recorded in Chart 2.

| INITIAL pH | pH AFTER ADJUSTMENT | SIDE TO SIDE RESISTANCE (OHMS) AFTER PROCESSING |
|---|---|---|
| 11.8 | 11.8 | 1050 |
| 11.8 | 12.2 | 20 |
| 11.8 | 13.4 | 23 |

These results illustrate the improvement in side to side resistance obtained by adjusting the pH from 11.8 to 12.2. Although the difference is not as great as the difference between the original used accelerator solution and the accelerator solution adjusted to pH 12.2, the results likewise illustrate the higher resistance obtained when the pH is raised enough to precipitate cupric ions.

The quantity of alkali hydroxide required to raise the pH of a used accelerator bath to the desired pH range may be determined using the following procedure.

PROCEDURE FOR DETERMINATION OF ADDITIONS TO ADJUST pH OF USED ACCELERATOR BATH

1. Place a 100 ml sample of used accelerator bath into a 250 ml beaker. Place a magnetic stirring bar into the beaker and place the beaker onto a magnetic stirrer operated at medium speed.

2. Using a pH meter standardized with pH 10 buffer, place the electrode(s) of the pH meter into the stirring sample. Allow to stir at least 5 minutes until pH meter stabilizes.

3. Titrate with standard sodium hydroxide solution (0.5 N or 1.0 N is usually preferred) to pH 12.2 or other desired pH.

4. Calculations: ml sodium hydroxide solution×Normality of sodium hydroxide × bath volume ×x$f$=mls 50% sodium hydroxide to add to accelerator bath.

When bath volume is measured in gallons, $f$=2.04.

When bath volume is measured in liters, $f$=0.54.

Alternatively, in lieu of manual pH measurements and additions, an automatic pH controller may be used to measure the pH and restore the pH to the desired range. Commercial pH controllers, such as the OS-TECH DCS-1, a product of Oliver Sales Company, Dallas, Tex., are suitable for this purpose. When using an automatic pH controller, it may be preferred to use a more dilute solution of alkali metal hydroxide for pH adjustments than that used for manual additions to the bath. More dilute solutions are less likely to over shoot the desired pH range when making additions to the used bath.

We claim:

1. A method to prolong the useful life of an alkaline accelerator bath comprising the steps of: measuring the pH of a used accelerator bath, and adjusting the pH of the bath to a desired range between 12.2 and 12.6 by adding alkali metal hydroxide.

2. The method called for in claim 1 wherein the alkali metal hydroxide is selected from the group consisting of hydroxides of sodium, potassium, lithium, rubidium, and cesium.

3. A method to prolong the useful life of an alkaline accelerator bath having cupric ions contained therein comprising the steps of: measuring the pH of a used accelerator bath, and adjusting the pH of the bath to a desired range between 12.2 to 12.6 by adding alkali metal hydroxide solution.

4. The method called for in claim 3 wherein the alkali metal hydroxide solutions consists of one or more of the following group: hydroxides of sodium, potassium, lithium, rubidium, and cesium.

* * * * *